US006689533B2

(12) United States Patent
Irita

(10) Patent No.: US 6,689,533 B2
(45) Date of Patent: Feb. 10, 2004

(54) DYE-FIXING ELEMENT FOR COLOR DIFFUSION TRANSFER PROCESS, AND IMAGE-FORMING METHOD USING THE SAME

(75) Inventor: Kiyoshi Irita, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/284,141

(22) Filed: Oct. 31, 2002

(65) Prior Publication Data

US 2003/0194637 A1 Oct. 16, 2003

(30) Foreign Application Priority Data

Nov. 2, 2001 (JP) ..... 2001-338534

(51) Int. Cl.[7] ..... G03C 1/815; G03C 8/24; G03C 8/52; G03C 8/40

(52) U.S. Cl. ..... 430/203; 430/213; 430/215; 430/220; 430/216; 430/236; 430/512; 430/931

(58) Field of Search ..... 430/215, 220, 430/512, 203, 216, 931, 236

(56) References Cited

U.S. PATENT DOCUMENTS 3,460,942 A * 8/1969 Rogers ..... 430/215
5,919,552 A * 7/1999 Malhotra ..... 430/47

FOREIGN PATENT DOCUMENTS

JP 46-3335 A 10/1971
JP 57-157245 A 9/1982
JP 61-153638 A 7/1986

* cited by examiner

*Primary Examiner*—Richard L. Schilling
(74) *Attorney, Agent, or Firm*—Sughrue Mion, PLLC

(57) ABSTRACT

A dye-fixing element for color diffusion transfer process, having an ultraviolet-absorbing layer that contains an ultraviolet absorber in a coating amount of 0.2 g/m$^2$ or more, over a mordant layer; and containing, as at least one dispersion medium for the ultraviolet absorber, a compound represented by formula (1), in a ratio (mass ratio) of 25 to 200% of the ultraviolet absorber; with the sum of coating amounts of the ultraviolet absorber and total dispersion medium for the ultraviolet absorber being 1.0 g/m$^2$ or less;

Formula (1)

wherein x and y each represent a molar fraction of each recurring unit, the total of x and y is 1, and y ranges from 0.85 to 0.95.

11 Claims, No Drawings

DYE-FIXING ELEMENT FOR COLOR DIFFUSION TRANSFER PROCESS, AND IMAGE-FORMING METHOD USING THE SAME

FIELD OF THE INVENTION

The present invention relates to a method for improving light fastness of an image obtained on a dye-fixing element, in an image-forming system using a photosensitive element and a dye-fixing element. More specifically, the present invention relates to an image-forming method of generating and releasing an image-forming dye by exposure of a photosensitive silver halide to light and development thereof, and diffusing and transferring the image-forming dye from a photosensitive layer to an image-receiving layer so as to form an image, with the method being capable of forming the image improved in fastness to light. The present invention also relates to a dye-fixing element used in a method of generating and releasing an image-forming dye by exposure of a photosensitive silver halide to light and development thereof, and diffusing and transferring the image-forming dye from a photosensitive layer to an image-receiving layer, to form an image.

BACKGROUND OF THE INVENTION

As a method of generating or releasing and diffusing an image-forming dye by exposure of a photosensitive silver halide to light, and development thereof, and then transferring the image-forming dye, to form an image, there are known a method using a color diffusion transfer-type photographic material (so-called instant photography), a heat-developable color diffusion transfer system, and a method using photosensitive microcapsules.

Images obtained by these methods are generally poorer in light resistance than images obtained by conventional photography system. Therefore, various methods that obtain an image improved with light resistance have been investigated.

Many methods, such as a use of a color-fading inhibitor, a contrivance of a layer structure, and a deposition of an oxygen barrier layer, have been investigated. Among these, methods using an ultraviolet absorber as a color-fading inhibitor have been reported (JP-A-46-3335 ("JP-A" means unexamined published Japanese patent application), JP-A-57-157245 and JP-A-61-153638).

The method is effective for improving light resistance of an image. However, to exhibit the effect sufficiently, it is necessary to cut off harmful ultraviolet rays sufficiently, and to add a large amount of an ultraviolet absorber. On the other hand, it is necessary, in principle, to add the ultraviolet absorber to a layer where a dye reacts with a mordant, or to a layer that is closer to the viewing surface than the mordant layer, and doing this unavoidably hinders the diffusion of this dye.

Thus, to attain the effect of cutting off ultraviolet rays sufficiently while an undesired effect on the diffusion of the dye is minimized, the percentage of the ultraviolet absorber in the layer in which the ultraviolet absorber is added inevitably becomes high, to produce an adverse effect that the physical strength of the layer becomes weak.

Particularly in a heat-developable color diffusion transfer process using heat to form an image, a mobile material, such as a salt, an oil, a base or a precursor thereof, added to a photosensitive material or a dye-fixing element, tends to diffuse by heating, so as to weaken the physical strength of the film. Therefore, the adverse effect on the physical strength by the addition of an ultraviolet absorber is rather remarkable.

SUMMARY OF THE INVENTION

The present invention is a dye-fixing element for color diffusion transfer process, having an ultraviolet-absorbing layer that contains an ultraviolet absorber in a coating amount of 0.2 g/m$^2$ or more, over a mordant layer; and containing, as at least one dispersion medium for the ultraviolet absorber, a compound represented by formula (1), in a ratio (mass ratio) of 25 to 200% of the ultraviolet absorber; with the sum of coating amounts of the ultraviolet absorber and total dispersion medium contained for the ultraviolet absorber being 1.0 g/m$^2$ or less;

Formula (1)

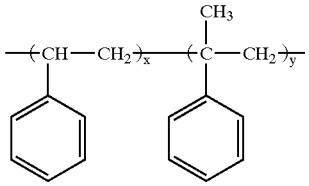

wherein x and y each represent a molar fraction of each recurring unit, the total of x and y is 1, and y ranges from 0.85 to 0.95.

Further, the present invention is an image-forming method using the above dye-fixing element.

Other and further features and advantages of the invention will appear more fully from the following description.

DETAILED DESCRIPTION OF THE INVENTION

The inventor, having made investigations to solve the above-mentioned problems, has found out that, by using a certain water-insoluble copolymer as at least one species of a dispersion medium for an ultraviolet absorber, dispersing the absorber, and introducing the absorber into a dye-fixing element, the light fastness of an image can be remarkably improved without deteriorating the physical strength of the film containing the absorber. Thus, the present invention has been made based on this finding.

According to the present invention, there are provided the following means:

(1) A dye-fixing element for a color diffusion transfer process, having an ultraviolet-absorbing layer that contains an ultraviolet absorber in a coating amount of 0.2 g/m$^2$ or more, over a mordant layer (on the side where an image is to be observed); and containing, as at least one dispersion medium for the ultraviolet absorber, a compound represented by formula (1), in a ratio (mass ratio) of 25 to 200% of the ultraviolet absorber, and the sum of coating amounts of the ultraviolet absorber and total dispersion medium contained for the ultraviolet absorber being 1.0 g/m$^2$ or less;

Formula (1)

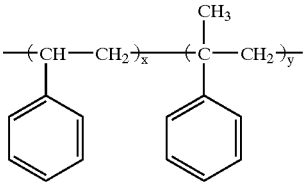

wherein x and y each represent a molar fraction of each recurring unit, the total of x and y is 1, and y ranges from 0.85 to 0.95.

In the present specification, the above-mentioned formula represents the molar fractions of the recurring units in the copolymer, and the bonding manner therein is not particularly limited (for example, the copolymer can be a block copolymer or a random copolymer).

(2) The dye-fixing element according to item (1), wherein, in the ultraviolet-absorbing layer, a water-soluble polymer is used as a binder, in an amount of 50 to 200% of the sum of masses of the ultraviolet absorber and total dispersion medium.

(3) The dye-fixing element according to item (2), wherein 50 to 100% of the water-soluble polymer used as the binder in the ultraviolet-absorbing layer is a gelatin.

(4) The dye-fixing element according to item (1), (2), or (3), which is used in a heat-developable color diffusion transfer process.

(5) An image-forming method, comprising using the dye-fixing element according to any one of items (1) to (4) in combination with a photosensitive element.

The present invention will be described in detail hereinafter.

The "ultraviolet-absorbing layer" in the present invention means a layer that absorbs at least one part of ultraviolet rays, which are originally to reach the next layer, by absorbing ultraviolet rays arriving at the layer. One of the distinguishing features of the ultraviolet-absorbing layer in the present invention is that an ultraviolet absorber is at least added thereto, in a coating amount of 0.2 g/m$^2$ or more. The upper limit of the total coating amount of the ultraviolet absorber and one or more dispersion medium(s) used to disperse the ultraviolet absorber, which will be described later, is 1.0 g/m$^2$.

In the present invention, the ultraviolet-absorbing layer is arranged between protective layers, or between a protective layer and a dye-fixing layer. The ultraviolet-absorbing layer may be formed as a single layer structure, or as a multilayered structure, which has plural divided layers.

As the ultraviolet absorber to be added to the ultraviolet-absorbing layer in the present invention, a compound having an appropriate absorption property may be selected from known organic compounds, and used. A compound which is not generally used as an ultraviolet absorber, but has an absorption within the ultraviolet range from 320 nm to 400 nm—an absorption in the range has a very intense effect on light resistance of the dye-fixing element—may also be used as the ultraviolet absorber in the present invention.

In view of the advantageous effect of the present invention, the material added to the ultraviolet-absorbing layer is preferably an organic ultraviolet absorber, and is more preferably one selected from ordinary organic ultraviolet absorbers and/or compounds similar thereto, which will be listed up below.

Specific examples of the organic ultraviolet absorber include benzotriazole compounds (described in, for example, U.S. Pat. No. 3,533,794); 4-thiazolidone compounds, benzophenone compounds (described in, for example, JP-A-46-2784); ester compounds of cinnamic acid (described in, for example, U.S. Pat. No. 3,705,805 and U.S. Pat. No. 3,707,375); benzoxazole compounds (described in, for example, U.S. Pat. No. 3,700,455); butadiene compounds (described in, for example, U.S. Pat. No. 4,045,229); compounds described in U.S. Pat. No. 3,499,792, JP-A-54-48535, and the like; and compounds mentioned as typical ultraviolet absorbers in general remarks of publications such as "Shigaisen Shadan (UV cut) Sozai no Tokusei to Ouyo (Property and Application of Ultraviolet Cutting-off (UV Cut) Material)" (Gijutsu Joho Kyokai (Technical Information Society)), for example, cyanoacrylate compounds and triazine compounds.

The above-mentioned known ultraviolet absorbers may be used alone or in a combination of two or more kinds, as the organic ultraviolet absorber(s) in the present invention.

The method for introducing an ultraviolet absorber into an ultraviolet-absorbing layer in the present invention is a method of using the ultraviolet absorber together with a dispersion medium, and introducing the ultraviolet absorber as an emulsion. As this dispersion medium, at least, the compound represented by the formula (1) is used in an amount of 25 to 200%, preferably 25 to 100%, of the mass of the ultraviolet absorber. If this requirement is satisfied, another generally-known dispersion medium may be additionally used together with the compound represented by the formula (1), as a dispersion medium to emulsify and disperse the ultraviolet absorber. For example, a water-soluble polymer, a typical example of which is gelatin, may be used together. In addition, examples of a water-soluble polymer for use as a binder in the ultraviolet-absorbing layer include poly(acrylic acid), poly(vinyl alcohol), modified poly(vinyl alcohol), copolymer of poly(acrylic acid) and poly(vinyl alcohol), dextran, and the like.

The compound represented by the formula (1) is not specified particularly by its molecular mass. Preferably, the compound has a low molecular mass. The mass average molecular mass thereof is preferably from 300 to 5000.

As the compound represented by the formula (1), a commercially available compound may be used. An example thereof is Crystalex 1120 (made by Hercules Inc.).

The image-fixing material used in the present invention has, at least, a layer for fixing a dye that forms an image, on a support, and to this dye-fixing layer is added a mordant. If necessary, a surface protecting layer, a timing layer, and an acid neutralizing layer may be provided, and the following (s) may be incorporated thereto: a binder, a base generator, a thermal solvent, an antifoggant, a stabilizer, a hardener, a plasticizer, a high-boiling organic solvent, an auxiliary coating agent, a surfactant, an antistatic agent, a matt agent, a lubricant, an antioxidant, and the like.

Specifically, the following may be applied: additives, materials and layer structures used in a dye-fixing element described in JP-A-8-304982, a dye image-receiving material described in JP-A-9-5968, an image-receiving material described in JP-A-9-34081, an image-receiving element described in JP-A-10-142765, and an image-receiving element (dye-fixing element) described in JP-A-9-152705. More preferred modes are also described therein.

The photosensitive material used in the present invention is basically a material having a photosensitive silver halide, a binder, and a dye donating compound, on a support. If necessary, the photosensitive material may contain a chemical sensitizer, a sensitivity-enhancing agent, a spectral sensitizer, a supersensitizer, a brightening agent, an antifoggant, a stabilizer, a light absorber, a filter dye, a hardener, a base generator, a plasticizer, a high-boiling organic solvent, an auxiliary coating agent, a surfactant, an antistatic static agent, a matte agent, and the like.

Specific examples of the photosensitive material include a heat-developable color photosensitive material described in JP-A-9-15805, a diffusion transfer silver halide photosensitive material described in JP-A-9-152705, a color photosensitive material described in JP-A-9-90582, a heat-developable color photosensitive material described in JP-A-9-34081, and a color diffusion transfer photosensitive material described in JP-A-10-142765. More preferred modes are also described therein.

If necessary, an alkali processing composition may be used in the present invention. The alkali processing composition is a composition which is uniformly spread between a photosensitive element and an image-receiving element after the photosensitive element is exposed to light, to carry out development of the photosensitive layer. The composition contains an alkali and a developing agent. If necessary, the composition can contain a viscosity-enhancing agent, a development accelerator, a development inhibitor, an antioxidant, and the like. Specifically, a processing composition described in JP-A-10-142765 falls under this composition. More preferred modes are also described therein.

In the present invention, examples of a support of a photosensitive material or an image-fixing material include photographic bases, such as synthetic polymers (films) and papers described in "Shashin Kogaku no Kiso—Ginen Shashin-hen—(Principles of Photographic Science and Engineering—Silver Salt Photography Version—)", pages (223)–(224), edited by Nihon shashin-gakkai (the Society of Photographic Society and Technology of Japan), and published by Corona-sha (Corona Publishing Co., Ltd.) (1979), and the like. Specific examples thereof include polyethylene terephthalate (PET); polyethylene naphthalate; polycarbonate; polyvinyl chloride; polystyrene; polypropylene; polyimide; celluloses (for example, triacetylcellulose); films wherein a pigment, such as titanium oxide, is incorporated into any one of these films; synthetic paper made from polypropylene and the like; paper made by mixing synthetic resin pulp, such as polyethylene, and natural pulp; Yankee paper; baryta paper; coated paper (particularly, cast-coated paper); metal; cloths; glasses; and ceramics, and the like.

These may be used alone, or may be used as a support wherein one surface or two surfaces of any one of these supports is laminated with a synthetic polymer, such as polyethylene, PET, polyester, polystyrene, or the like.

Besides, a support described in JP-A-62-253159, pages (29)–(31), JP-A-1-161236, pages (14)–(17), JP-A-63-316848, JP-A-2-22651 and JP-A-3-56955, U.S. Pat. No. 5,001,033, or the like, can be used.

An antistatic agent including carbon black, a hydrophilic binder, a semi-conductive metal oxide, such as alumina sol or tin oxide, and the like may be applied to the surface of the above-mentioned support.

In order to improve wettability of the coating solution and to improve adhesion between the coating film and the support, it is preferred to apply a gelatin, or a polymer, such as PVA, to the surface of the support, in advance.

The thickness of the support varies dependently on the purpose of the use thereof, and is usually 40 $\mu$m or more and 400 $\mu$m or less. However, in the case of a method that forms an image using elements applied onto two or more separate supports, the support of the element an image on which is not used as an end product image, is preferably a thinner support having a thickness range of smaller than the above-mentioned range (5 $\mu$m or more and 250 $\mu$m or less). As such a thin support, there is used, for example, a film wherein aluminum is vacuum-evaporated on PET.

Particularly, in the case in which heat resistance and curling property are strictly requested, a support described in the following can be preferably used as the support for the photosensitive material: JP-A-6-41281, JP-A-6-43581, JP-A-6-51426, JP-A-6-51437, JP-A-6-51442, JP-A-6-82961, JP-A-6-82960, JP-A-6-82959, JP-A-6-67346, JP-A-6-202277, JP-A-6-175282, JP-A-6-118561, JP-A-7-219129, or JP-A-7-219144.

Examples of the method of exposing the photographic material to light and recording an image, include a method wherein a landscape, a man, or the like is directly photographed by a camera or the like; a method wherein a reversal film or a negative film is exposed to light using, for example, a printer, or an enlarging apparatus; a method wherein an original picture is subjected to scanning exposure through a slit or the like, by using an exposure system of a copying machine or the like; a method wherein light-emitting diodes, various lasers and the like, are allowed to emit light, to carry out exposure of image information through electrical signals; and a method wherein image information is outputted to an image display device, such as a CRT, a liquid crystal display, an electroluminescence display, a plasma display or the like, and exposure is carried out directly or through an optical system.

Light sources that can be used for recording an image on the photographic material, as mentioned above, include natural light and light sources and exposure methods described in U.S. Pat. No. 4,500,626, 56th column, JP-A-2-53378 and JP-A-2-54672, such as a tungsten lamp, a light-emitting diode, a laser light source, and a CRT light source.

In addition, a light source wherein a blue light-emitting diode, which has been remarkably developed in recent years, is combined with a green light-emitting diode and a red light-emitting diode, can be used. Particularly, an expose device described in the following can be preferably used: JP-A-7-140567, JP-A-7-248549, JP-A-7-248541, JP-A-7-295115, JP-A-7-290760, JP-A-7-301868, JP-A-7-301869, JP-A-7-306481, and JP-A-8-15788.

Further, image-wise exposure can be carried out by using a wavelength-converting element that uses a nonlinear optical material and a coherent light source, such as laser rays, in combination. Herein, the term "nonlinear optical material" refers to a material that can develop nonlinearity between the electric field and the polarization that appears when subjected to a strong photoelectric field, such as laser rays, and inorganic compounds, represented by lithium niobate, potassium dihydrogenphosphate (KDP), lithium iodate, and $BaB_2O_4$; urea derivatives; nitroaniline derivatives; nitropyridine-N-oxide derivatives, such as 3-methyl-4-nitropyridine-N-oxide (POM); and compounds described in JP-A-61-53462 and JP-A-62-210432 can be preferably used. As the form of the wavelength-converting element, for example, a single crystal optical waveguide type and a fiber type are known, and all of which are useful.

The above image information can be, for example, image signals obtained from video cameras, electronic still cameras, and the like; television signals, represented by Nippon Television Singo Kikaku (NTSC); image signals obtained by dividing an original picture into a number of picture elements by a scanner or the like; and image signals produced by a computer, represented by CG or CAD.

The photosensitive material and/or the dye-fixing element for use in the present invention can be used for various purposes. For example, the dye-fixing element after subjected to heat-development transfer can be used as a positive or negative color print material. Further, by using a photosensitive material, wherein a black dye-providing substance, or a mixture of yellow-, magenta- and cyan-dye-providing substances is used, it can be used as a black and white positive or negative print material, a material for printing such as a photosensitive material for lithography, or a material for radiography. In the case in which the dye-fixing element of the present invention is particularly used as a material for obtaining a print from a shooting (photographing) material, it is preferred to expose the photosensitive material to light, using a shooting material having information-recording function as described in JP-A-6-163450 and JP-A-4-338944, and to form a print on the dye-fixing element of the present invention by heat-development transfer. As this printing method, a method described in JP-A-5-241251, JP-A-5-19364 or JP-A-5-19363 can be used.

The photosensitive material after heat-development transfer may be appropriately subjected to desilvering treatment, whereby the photosensitive material can be used as a shooting material. In this case, it is preferred to use, as its support, a support having a magnetic substance layer described in JP-A-4-124645, JP-A-5-40321, JP-A-6-35092 or JP-A-6-317875, and record shooting data and the like.

The photographic material and/or dye-fixing material may be in a form having an electro-conductive heat-generating element layer, which serves as a heating means for heat development and diffusion transfer of a dye. In this case, as the heat-generating element, those described, for example, in JP-A-61-145544 can be employed.

The heating temperature in the heat-development step is generally about 50° C. to about 250° C., and particularly a heating temperature about 60° C. to 180° C. is effective. The step of diffusion transfer of a dye may be carried out simultaneously with heat development, or it may be carried out after the completion of the heat-development step. In the latter case, although the transfer can be made in a temperature range between the temperature in the heat developing step and room temperature, the heating temperature in the transfer step is more preferably 50° C. or higher, but equal to or lower than the temperature that is lower by 10° C. than the temperature in the heat developing step.

The transfer of a dye can be caused only by heat. However, a solvent may be used to accelerate the dye-transfer. A method of carrying out heating in the presence of a small amount of a solvent (particularly, water), to perform development and transfer simultaneously or successively, which is described in U.S. Pat. No. 4,704,345, U.S. Pat. No. 4,740,445, JP-A-61-238056, or the like, is also useful. In this system, the heating temperature is preferably from 50° C. to the boiling point of the solvent. When the solvent is, for example, water, the heating temperature is preferably 50° C. to 100° C.

Examples of the solvent used to accelerate development and/or diffuse and transfer a dye include water, aqueous basic solutions containing an inorganic alkali metal salt or an organic base (those described in the above mentioned JP-A-61-238,056 on page 4, upper right column, line 9 to page 6, upper left column, line 8, can be used as the base), low-boiling point solvents, and a mixed solution of a low-boiling solvent with water or with the above-mentioned aqueous basic solution. Further, a surfactant, an antifoggant, a compound which is combined with a slightly soluble metal salt to form a complex, an antifungal agent, and an anti-bacterial agent, may be contained in the solvent.

The solvent used in the steps of heat development and diffusion transfer is preferably water. The water may be any water which is generally used. Specific examples thereof include distilled water, tap water, well water and mineral water. In a heat-developing apparatus in which a light-sensitive material and an image-receiving element are used, water may be used in a batch form or circulating form. In the latter case, water that contains substances eluted from the material is used. Water and apparatuses described in JP-A-63-144354, JP-A-63-144355, JP-A-62-38460, JP-A-3-210555, and the like may be used.

The above-mentioned solvent may be supplied to the light-sensitive material, or the dye-fixing element, or both of the two. The amount to be used thereof is equal to or less than the mass of the solvent corresponding to the maximum swelling volume of all of the applied films.

As the method of supplying water, for example, the method described in JP-A-62-253159, page (5) and JP-A-63-85544 is preferably used. The solvent may be confined in microcapsules, or may take the form of a hydrate, to be previously incorporated into either or both of the light-sensitive material and the dye-fixing element, for use.

The temperature of the supplied water may be from 30° C. to 60° C. as described in the above-mentioned JP-A-63-85544, and the like.

To accelerate the dye transfer, a system can be adapted where a hydrophilic heat solvent that is solid at normal temperatures and melts at a higher temperature, can be built in the light-sensitive material and/or the dye-fixing element. The layer wherein the hydrophilic heat solvent is built in, may be any of the light-sensitive silver halide emulsion layer, the intermediate layer, the protective layer, and the dye-fixing layer, but preferably it is built-in the dye-fixing layer and/or the layer adjacent thereto.

Examples of the hydrophilic heat solvent include ureas, pyridines, amides, sulfonamides, imides, alcohols, oximes, and other heterocyclic compounds.

Examples of a heating method in the development step and/or transferring step include one wherein the photographic material is brought in contact with a heated block or plate; a method wherein the photographic material is brought in contact with a hot plate, a hot presser, a hot roller, a hot drum, a halogen lamp heater, an infrared lamp heater, or a far-infrared lamp heater; and a method wherein the photographic material is passed through a high-temperature atmosphere.

As a method wherein the photographic material and a dye-fixing material are placed one upon the other, methods described in JP-A-62-253159 and JP-A-61-147244, on page (27) can be applied.

To process the photographic elements for use in the present invention, any of various development apparatuses can be used. For example, apparatuses described, for example, in JP-A-59-75247, JP-A-59-177547, JP-A-59-181353, JP-A-60-18951, unexamined published Japanese Utility Model Application (JU-A) No. 62-25944, JP-A-6-130509, JP-A-6-95338, JP-A-6-95267, JP-A-8-29955, JP-A-8-29954, and the like can be preferably used. Besides, as a commercially available development apparatus, for example, PICTROSTAT 100, PICTROSTAT 200, PICTROSTAT 300, PICTROSTAT 330, PICTROGRAPHY 3000, and PICTROGRAPHY 4000 (trade names, all produced by Fuji Photo Film Co., Ltd.), may be used.

According to the dye-fixing element of the present invention, it is possible to form an image excellent in light fastness, without lowering film strength, and it is also possible to realize an image-forming method that gives an image excellent in light fastness, without deteriorating film strength, in a method where an image-forming dye or a precursor thereof is released or generated in association with silver development, and an image is formed by diffusion transfer of the dye.

The dye-fixing element of the present invention is preferable for use in a method where an image-forming dye or a precursor thereof is released or generated, corresponding to silver development or reversely corresponding thereto, and an image is formed by diffusing and transferring the dye. The image-forming method of the present invention can form a color image excellent in light resistance, without deteriorating physical strength of the film using the above dye-foxing element.

Further, a color image-forming material, such as a heat-developable color diffusion transfer photosensitive material, using the above-mentioned dye-fixing element, exhibits excellent effect of forming an image excellent in light fastness, without lowering film strength as mentioned in the above.

The present invention will be described in more detail based on the following examples, but the present invention is not limited thereto.

EXAMPLES

Example 1

First, a preparation method of a dye-fixing element will be explained. Coating was carried out onto a support shown in Table 1, to have a layer constitution shown in Table 2. In this way, a dye-fixing element 100 was prepared. This dye-fixing element, which had no ultraviolet-absorbing layer, was a Comparative Example to the present invention.

TABLE 1

Constitution of Support

| Name of layer | Composition | Film thickness (μm) |
|---|---|---|
| Surface undercoat layer | Gelatin | 0.1 |
| Surface PE layer (Glossy) | Low-density polyethylene (PE) (Density 0.923): 90.2 parts by mass<br>surface-processed titanium oxide: 9.8 parts by mass<br>Ultramarine: 0.001 parts by mass | 36.0 |
| Pulp layer | Fine quality paper (LBKP/NBSP = 6/4, Density 1.053) | 152.0 |
| Back-surface PE layer (Matt) | High-density polyethylene (Density 0.955) | 27.0 |
| Back-surface undercoat layer | Styrene/acrylate copolymer<br>Colloidal silica<br>Polystyrenesulfonic acid sodium salt | 0.1 |
| | | 215.2 |

TABLE 2

Constitution of dye-fixing material 100

| Number of layer | Additive | Coating amount (mg/m$^2$) |
|---|---|---|
| Sixth layer | Water-soluble polymer (1) | 130 |
| | Water-soluble polymer (2) | 35 |
| | Water-soluble polymer (3) | 45 |
| | Potassium nitrate | 20 |
| | Anionic surfactant (1) | 6 |
| | Anionic surfactant (2) | 6 |
| | Amphoteric surfactant (1) | 50 |
| | Stain-preventing agent (1) | 7 |
| | Stain-preventing agent (2) | 12 |
| | Matt agent (1) | 7 |
| Fifth layer | Gelatin | 570 |
| | Anionic surfactant (3) | 25 |
| | High-boiling organic solvent (2) | 450 |
| | Hardener (1) | 60 |
| Forth layer | Mordant (2) | 1850 |
| | Water-soluble polymer (2) | 260 |
| | Water-soluble polymer (4) | 1400 |
| | Dispersion of latex (1) | 600 |
| | Anionic surfactant (3) | 25 |
| | Nonionic surfactant (1) | 18 |
| | Guanidine picolinate | 2550 |
| | Sodium quinolinate | 350 |
| Third layer | Gelatin | 370 |
| | Mordant (1) | 300 |
| | Anionic surfactant (3) | 12 |
| Second layer | Gelatin | 700 |
| | Mordant (1) | 290 |
| | Water-soluble polymer (1) | 55 |
| | Water-soluble polymer (2) | 330 |
| | Anionic surfactant (3) | 30 |
| | Anionic surfactant (4) | 7 |
| | High-boiling organic solvent (1) | 700 |
| | Brightening agent (1) | 30 |
| | Stain-preventing agent (3) | 32 |
| | Guanidine picolinate | 360 |
| | Potassium quinolinate | 45 |
| First layer | Gelatin | 190 |
| | Water-soluble polymer (1) | 8 |
| | Anionic surfactant (1) | 10 |
| | Sodium metaborate | 23 |
| | Hardener (1) | 300 |

Support: Paper Support described in Table 1 (thickness 215 μm)

Note: The coating amount of dispersion of latex is in terms of the coating amount of solid content of latex.

Anionic surfactant (1)

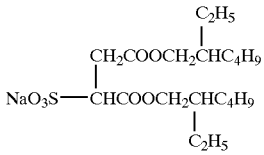

Anionic surfactant (2)

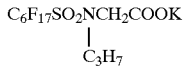

Anionic surfactant (3)

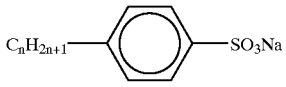

n = 12.6

-continued

Anionic surfactant (4)

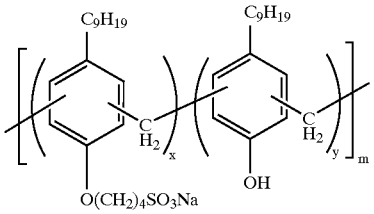

x:y = 4:6
m = 6.8

Nonionic surfactant (1)

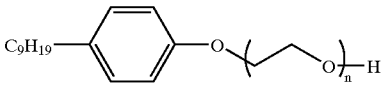

n = 85

Amphoteric surfactant (1)

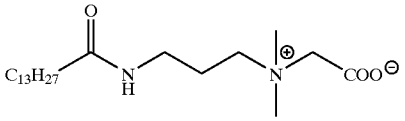

Brightening agent (1)

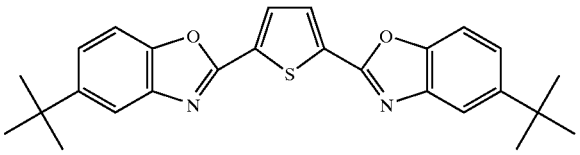

Mordant (1)

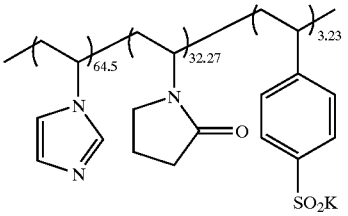

Stain-preventing agent (1)

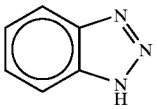

Stain-preventing agent (2)

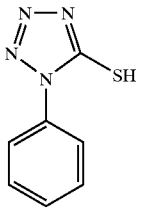

High-boiling organic solvent (1)

$C_{26}H_{48.9}Cl_{7.1}$

EMPARA 40 (trade name, manufactured by Ajinomoto K.K)

Water-soluble polymer (1)

Sumilagel L5-H (trade name, manufactured by Sumitomo Kagaku Co., Ltd.)

Water-soluble polymer (2)

Dextran (molecular weight 70,000)

-continued

Water-soluble polymer (3)

κ(kappa)-Carrageenan (trade name, manufactured by Taito Co.)

Water-soluble polymer (4)

MP Polymer MP-102

(trade name, manufactured by Kuraray Co.)

Matt agent (1)

SYLYSIA 431

(trade name, manufactured by Fuji silysia chemical Ltd.)

Hardener (1)

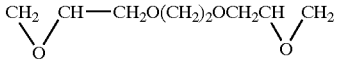

Dispersion of latex (1)

LX-438

(trade name, manufactured by Nippon Zeon Co.)

High-boiling organic solvent (1)

Chlorinated paraffin (chlorination ratio: 40%)

High-boiling organic solvent (2)

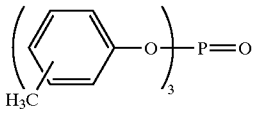

High-boiling organic solvent (3)

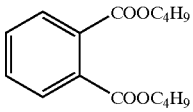

(3)

Compound (4)

CRYSTALEX 1120

(a compound wherein x is 0.1 and y is 0.9 in the formula (1); manufactured by Hercules Inc.)

Ultraviolet absorber (1)

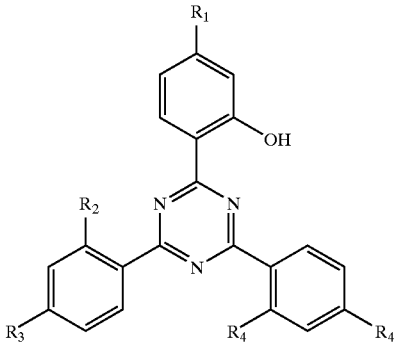

$R_1$: $—CH_2CH(OH)OCH_2CH(Et)_2$ $R_2$, $R_3$, $R_4$: $CH_3$

An ultraviolet absorber (1) was dispersed using a dispersion medium shown in Table 3. This dispersed product was added to the fifth layer of the dye-fixing element to make the layer as an ultraviolet-absorbing layer. Thus, Dye-fixing elements 101 to 110 were prepared. Among them, Dye-fixing elements 108 to 109 were those according to the present invention, while the others were Comparative Examples for checking the effects of the present invention by comparison. The compound (4) used in the Dye-fixing elements 108 to 110 was a dispersion medium for use in the present invention. As the compound represented by formula (1), Crystalex 1120 (trade name), commercially available from Hercules Inc., was used.

TABLE 3

| Kind and addition amount of Color-fading inhibitor and Brightening agent in the dye-fixing material | | | |
|---|---|---|---|
| | Dispersion medium | | Ultraviolet absorber* |
| Dye-fixing material | Compound | Addition amount ($g/m^2$) | Addition amount ($g/m^2$) |
| 100 | None | None | None |
| 101 | High-boiling organic solvent (1) | 0.2 | 0.5 |
| 102 | High-boiling organic solvent (1) | 0.5 | 0.5 |
| 103 | High-boiling organic solvent (1) | 0.7 | 0.5 |
| 104 | High-boiling organic solvent (2) | 0.2 | 0.5 |
| 105 | High-boiling organic solvent (2) | 0.5 | 0.5 |
| 106 | High-boiling organic solvent (3) | 0.2 | 0.5 |
| 107 | High-boiling organic solvent (3) | 0.5 | 0.5 |
| 108 | Compound (4) | 0.2 | 0.5 |
| 109 | Compound (4) | 0.5 | 0.5 |
| 110 | Compound (4) | 0.7 | 0.5 |

Then, a preparation method of a heat-developable color photosensitive material will be explained.

First, the preparation method of a photosensitive silver halide emulsion will be explained.

Photosensitive Silver Halide Emulsion (1) (Emulsion for the Fifth Layer (680 nm Light-sensitive Layer))

A (I) solution and a (II) solution having compositions shown in Table 5 were simultaneously added to a vigorously-stirred aqueous solution having a composition shown in Table 4, over 13 minutes. After 10 minutes from the addition, (III) and (IV) solutions having compositions shown in Table 5 were added thereto, over 33 minutes.

TABLE 4

| Composition | |
|---|---|
| $H_2O$ | 620 ml |
| Lime-processed gelatin | 20 g |
| KBr | 0.3 g |
| NaCl | 2 g |
| Silver halide solvent (1) | 0.030 g |
| Sulfuric acid (1N) | 16 ml |
| Temperature | 45° C. |

Silver halide solvent (1)

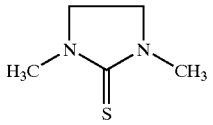

TABLE 5

| Component | Solution (I) | Solution (II) | Solution (III) | Solution (IV) |
|---|---|---|---|---|
| $AgNO_3$ | 30.0 g | None | 70.0 g | None |
| $NH_4NO_3$ | 0.125 g | None | 0.375 g | None |
| KBr | None | 13.7 g | None | 44.1 g |

TABLE 5-continued

| Component | Solution (I) | Solution (II) | Solution (III) | Solution (IV) |
|---|---|---|---|---|
| NaCl | None | 3.6 g | None | 2.4 g |
| $K_2IrCl_6$ | None | None | None | 0.039 mg |
| Total volume | Water to make 126 ml | Water to make 132 ml | Water to make 254 ml | Water to make 252 ml |

Further, after 13 min from the start of addition of solution (III), 150 ml of an aqueous solution containing 0.350% of sensitizing dye (1) was added over 27 min.

Sensitizing dye (1)

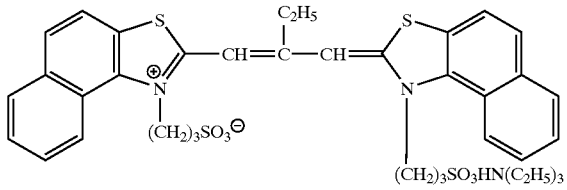

After washing with water and desalting (that was carried out using Settling agent a, at a pH of 4.1) in a usual manner, 22 g of lime-processed ossein gelatin was added, and then, after adjusting the pH and pAg to 6.0 and 7.9 respectively, the chemical sensitization was carried out at 60° C. The compounds used in the chemical sensitization are shown in Table 6. In this way, 630 g of a monodisperse cubic silver chlorobromide emulsion having a deviation coefficient of 10.2% and an average grain size of 0.20 $\mu$m was obtained.

Settling agent a.

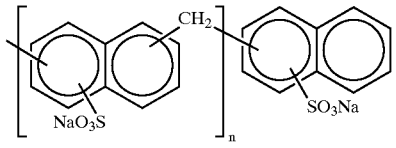

Settling agent b.

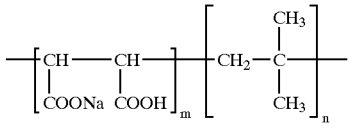

TABLE 6

| Chemicals used in chemical sensitization | Added amount |
|---|---|
| 4-Hydroxy-6-methyl-1,3,3a,7-tetrazaindene | 0.36 g |
| Sodium thiosulfate | 6.75 mg |
| Antifoggant (1) | 0.11 g |
| Antiseptic (1) | 0.07 g |
| Antiseptic (2) | 3.13 g |

Antifoggant ①

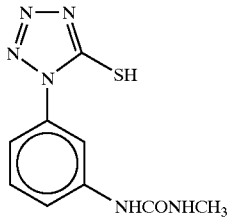

Antiseptic ①

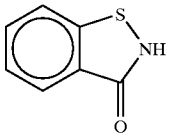

Antiseptic ②

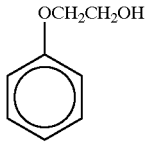

Photosensitive Silver Halide Emulsion (2) (Emulsion for the Third Layer (750 nm Light-sensitive Layer))

A (I) solution and a (II) solution having compositions shown in Table 8 were simultaneously added to a vigorously-stirred aqueous solution having a composition shown in Table 7, over 18 minutes. After 10 minutes from the addition, (III) and (IV) solutions having compositions shown in Table 8 were added thereto, over 24 minutes.

TABLE 7

| Composition | |
|---|---|
| $H_2O$ | 620 ml |
| Lime-processed gelatin | 20 g |
| KBr | 0.3 g |
| NaCl | 2 g |
| Silver halide solvent ① | 0.030 g |
| Sulfuric acid (1N) | 16 ml |
| Temperature | 45° C. |

TABLE 8

| Component | Solution (I) | Solution (II) | Solution (III) | Solution (IV) |
|---|---|---|---|---|
| $AgNO_3$ | 30.0 g | None | 70.0 g | None |
| $NH_4NO_3$ | 0.125 g | None | 0.375 g | None |
| KBr | None | 13.7 g | None | 44.1 g |
| NaCl | None | 3.6 g | None | 2.4 g |
| $K_4[Fe(CN)_6].H_2O$ | None | None | None | 0.065 g |
| $K_2IrCl_6$ | None | None | None | 0.040 mg |
| Total volume | Water to make 188 ml | Water to make 188 ml | Water to make 250 ml | Water to make 250 ml |

After washing with water and desalting (that was carried out using the above-described Settling Agent b at a pH of 3.9) in a usual manner, 22 g of lime-processed ossein gelatin from which calcium had been removed (the calcium content: 150 ppm or less) was added, re-dispersing was made at 40° C., 0.39 g of 4-hydroxy-6-methyl-1,3,3a,7-tetrazaindene was added, and the pH and pAg were adjusted to 5.9 and 7.8 respectively. Thereafter, the chemical sensitization was carried out at 70° C. The compounds used in the chemical sensitization are shown in Table 9. At the end of the chemical sensitization, Sensitizing Dye ② in the form of a methanol solution (the solution having the composition shown in Table 10) was added. After the chemical sensitization, the temperature was lowered to 40° C. and then 200 g of a gelatin dispersion of the later-described Stabilizer ① was added, followed by stirring well, and kept in a casing. In this way, 938 g of a monodisperse cubic silver chlorobromide emulsion having a deviation coefficient of 12.6% and an average grain size of 0.25 μm was obtained.

TABLE 9

| Chemicals used in chemical sensitization | Added amount |
|---|---|
| 4-Hydroxy-6-methyl-1,3,3a,7-tetrazaindene | 0.39 g |
| Triethylthiourea | 3.3 mg |
| Nucleic acid decomposition product | 0.39 g |
| NaCl | 0.15 g |
| KI | 0.12 g |
| Antifoggant ② | 0.10 g |
| Antiseptic ① | 0.07 g |

TABLE 10

| Composition of dye solution | Added amount |
|---|---|
| Sensitizing dye ② | 0.19 g |
| Methanol | 18.7 ml |

Stabilizer ①

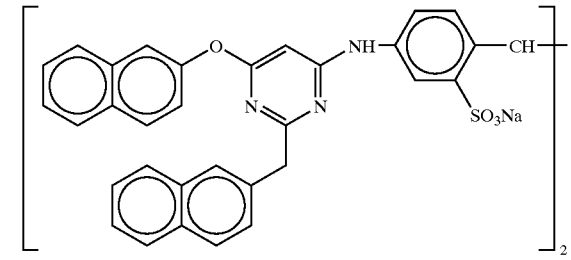

Anitfoggant ①

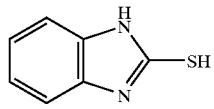

Sensitizing dye ②

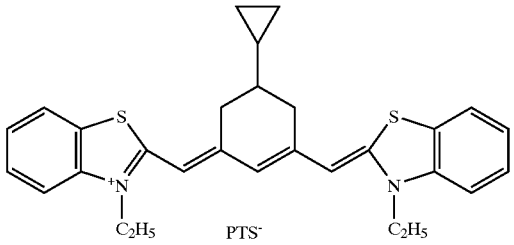

PTS: para-toluenesulfonic acid

Photosensitive Silver Halide Emulsive (3) (Emulsion for the First Layer (810 nm Light-sensitive Layer))

A (I) solution and a (II) solution having compositons shown in Table 12 were simultaneously added to a vigorously-stirred aqueous solution having a composition shown in table 11, over 18 minutes. After 10 minutes from the addition, (III) and (IV) solutions having compositions shown in Table 12 were added thereto over 24 minutes.

TABLE 11

| Composition | |
|---|---|
| $H_2O$ | 620 ml |
| Lime-processed gelatin | 20 g |
| KBr | 0.3 g |
| NaCl | 2 g |
| Silver halide solvent ① | 0.030 g |
| Sulfuric acid (1N) | 16 ml |
| Temperature | 50° C. |

TABLE 12

| | Solution (I) | Solution (II) | Solution (III) | Solution (IV) |
|---|---|---|---|---|
| $AgNO_3$ | 30.0 g | None | 70.0 g | None |
| KBr | None | 13.7 g | None | 44.1 g |
| NaCl | None | 3.62 g | None | 2.4 g |
| $K_2IrCl_6$ | None | None | None | 0.020 mg |
| Total volume | Water to make 180 ml | Water to make 181 ml | Water to make 242 ml | Water to make 250 ml |

After washing with water and desalting (that was carried out using Settling Agent a, at a pH of 3.8) in a usual manner, 22 g of lime-processed ossein gelatin was added, and after adjusting the pH and pAg to 7.4 and 7.8 respectively, the chemical sensitization was carried out at 60° C. The compounds used in the chemical sensitization are shown in Table 13. The yield of the resulting emulsion was 683 g. The emulsion was a monodispersion cubic silver chlorobromide emulsion of which the variation coefficient was 9.7% and the average grain size was 0.32 μm.

TABLE 13

| Chemicals used in chemical sensitization | Added amount |
|---|---|
| 4-Hydroxy-6-methyl-1,3,3a,7-tetrazaindene | 0.38 g |
| Triethylthiourea | 3.10 mg |
| Antifoggant ② | 0.19 g |
| Antiseptic ① | 0.07 g |
| Antiseptic ② | 3.13 g |

Next, the preparation method of a silver chloride fine-grain, to be added to the first layer (810 nm light-sensitive layer), is described below.

A (I) solution and a (II) solution having compositions shown in Table 15 were simultaneously added to a vigorously-stirred aqueous solution having a composition shown in Table 14, over 4 minutes. After 3 minutes from the addition, (III) and (IV) solutions having compositions shown in Table 15 were added thereto, over 8 minutes.

TABLE 14

| Composition | |
|---|---|
| $H_2O$ | 3770 ml |
| Lime-processed gelatin | 60 g |
| NaCl | 0.8 g |
| | 38° C. |

TABLE 15

| | Solution (I) | Solution (II) | Solution (III) | Solution (IV) |
|---|---|---|---|---|
| $AgNO_3$ | 300 g | None | 300 g | None |
| $NH_4NO_3$ | 10 g | None | 10 g | None |
| NaCl | None | 108 g | None | 104 g |
| Total volume | Water to make 940 ml | Water to make 940 ml | Water to make 1170 ml | Water to make 1080 ml |

After washing with water and desalting (that was carried out using Settling Agent a at a pH of 3.9) in a usual manner, 132 g of lime-processed gelatin was added, re-dispersing was made at 35° C., 4 g of 4-hydroxy-6-methyl-1,3,3a,7-tetrazaindene was added, and the pH was adjusted to 5.7. The yield of the resulting silver chloride fine-grain emulsion was 3,200 g, whose average grain size was 0.10 μm.

Next, the preparation method of a gelatin dispersion of colloidal silver is described below.

To a well-stirred aqueous solution having the composition shown in Table 16, was added a solution having the composition shown in Table 17, over 24 min. Thereafter, the washing with water using Settling Agent a was carried out, then 43 g of lime-processed ossein gelatin was added, and the pH was adjusted to 6.3. In this way, 512 g of a dispersion having average grain size of 0.02 μm, and containing silver 2% and gelatin 6.8% was obtained.

TABLE 16

| Composition | |
|---|---|
| $H_2O$ | 620 ml |
| Dextrin | 16 g |
| NaOH (5N) | 41 ml |
| Temperature | 30° C. |

TABLE 17

| Composition | |
|---|---|
| $H_2O$ | 135 ml |
| $AgNO_3$ | 17 g |

Then, the preparation methods of gelatin dispersions of hydrophobic additives are described.

Gelatin dispersions of a yellow-dye-providing compound, a magenta-dye-providing compound, and a cyan-dye-providing compound, whose formulations are shown in Table 18, were prepared, respectively. That is, the oil phase components were dissolved by heating to about 70° C., to form a uniform solution, and to the resultant solution, were added the aqueous phase components that had been heated to about 60° C., followed by stirring to mix and dispersing by a homogenizer for 10 min at 10,000 rpm. To the resultant dispersion, was added additional water, followed by stirring, to obtain a uniform dispersion. Furthermore, the resultant gelatin dispersion of the cyan dye-providing compound was repeatedly diluted with water and concentrated using an ultrafiltration module (ultrafiltration module: ACV-3050, trade name, made by Asahi Chemical Co., Ltd.), so that the amount of ethyl acetate would be 1/17.6 of the amount thereof shown in Table 18.

TABLE 18

| | Composition of dispersion (mg/m²) | | |
|---|---|---|---|
| | Yellow | Magenta | Cyan |
| Oil phase | | | |
| Cyan-dye-providing compound | None | None | 4.45 |
| Magenta-dye-providing compound | None | 5.27 | None |
| Yellow-dye-providing compound (1) | 1.68 | None | None |
| Yellow-dye-providing compound (2) | 4.03 | None | None |
| Reducing agent (1) | 0.47 | 0.06 | 0.29 |
| Antifoggant (3) | 0.1 | None | 0.06 |
| Antifoggant (4) | None | 0.21 | None |
| Surfactant (1) | 0.6 | 0.23 | 0.45 |
| High-boiling solvent (1) | 0.84 | None | 1.34 |
| High-boiling solvent (2) | 2.01 | 2.63 | 4.47 |
| High-boiling solvent (3) | None | None | None |
| Development accelerator (1) | 1.01 | None | None |
| Dye (a) | 0.59 | None | 0.14 |
| Water | 0.19 | None | 0.3 |
| Ethyl acetate | 10 | 16 | 16 |
| Aqueous phase | | | |
| Lime-processed gelatin | 5.5 | 3.1 | 2.4 |
| Calcium nitrate | 0.05 | 0.04 | None |
| Surfactant (1) | None | None | None |
| Sodium hydroxide aq. soln. (1 N) | None | None | 0.07 |
| Carboxymethyl cellulose | None | None | 31 |
| Water | 35 | 31 | 40 |
| Water (after emulsification) | 40 | 43 | 0.03 |
| Antiseptic (1) | 0.003 | 0.002 | None |

A gelatin dispersion of Antifoggant (4), whose formulation is shown in Table 19, was prepared. That is, the oil phase components were dissolved by heating to about 60° C. to form a solution, and to the resultant solution, were added the aqueous phase components that had been heated to about 60° C., and after stirring and mixing them, the resultant mixture was dispersed for 10 min at 10,000 rpm by a homogenizer, to obtain a uniform dispersion.

TABLE 19

| | Composition of dispersion |
|---|---|
| Oil phase | |
| Antifoggant (4) | 0.8 g |
| Reducing agent (1) | 0.1 g |
| High-boiling solvent (2) | 2.3 g |
| High-boiling solvent (5) | 0.2 g |
| Surfactant (1) | 0.5 g |
| Surfactant (4) | 0.5 g |
| Ethyl acetate | 10.0 ml |
| Aqueous phase | |
| Lime-processed gelatin | 10.0 g |
| Antiseptic (1) | 0.004 g |
| Calcium nitrate | 0.1 g |
| Water | 35.0 ml |
| Additional Water | 46.0 ml |

A gelatin dispersion of High-boiling solvent (2), whose formulation is shown in Table 20, was prepared. That is, the oil phase components were dissolved by heating to about 60° C. to form a solution, and to the resultant solution, were added the aqueous phase components that had been heated to about 60° C., and after stirring and mixing them, the resultant mixture was dispersed for 10 min at 10,000 rpm by a homogenizer, to obtain a uniform dispersion.

TABLE 20

| | Composition of dispersion |
|---|---|
| Oil phase | |
| High-boiling organic solvent (2) | 9.1 g |
| High-boiling organic solvent (5) | 0.2 g |
| Surfactant (1) | 0.5 g |
| Surfactant (4) | 0.5 g |
| Ethyl acetate | 10.0 ml |
| Aqueous phase | |
| Acid-processed gelatin | 10.0 g |
| Antiseptic (1) | 0.004 g |
| Calcium nitrate | 0.1 g |
| Water | 74.0 ml |
| Additional water | 104.0 ml |

A gelatin dispersion of Reducing Agent (2), whose formulation is shown in Table 21, was prepared. That is, the oil phase components were dissolved by heating to about 60° C. to form a solution, and to the resultant solution, were added the aqueous phase components that had been heated to about 60° C., and after stirring and mixing them, the resultant mixture was dispersed for 10 min at 10,000 rpm by a homogenizer, to obtain a uniform dispersion. From the thus-obtained dispersion, ethyl acetate was removed off using a vacuum organic solvent removing apparatus.

TABLE 21

| | Composition of dispersion |
|---|---|
| Oil phase | |
| Reducing agent (2) | 7.5 g |
| High-boiling solvent (1) | 4.7 g |
| Surfactant (1) | 1.9 g |
| Ethyl acetate | 14.4 ml |
| Aqueous phase | |
| Acid-processed gelatin | 10.0 g |
| Antiseptic (1) | 0.02 g |
| Antiseptic (4) | 0.04 g |
| Sodium hydrogensulfite | 0.1 g |
| Water | 136.7 ml |

A dispersion of Polymer Latex a, whose formulation is shown in Table 22, was prepared. That is, while a mixed solution of Polymer Latex a, Surfactant (5), and water, whose amounts are shown in Table 22, was stirred, Anionic Surfactant (6) was added thereto, over 10 min, to obtain a uniform dispersion. The resulting dispersion was repeatedly diluted with water and concentrated using an ultrafiltration module (Ultrafiltration Module: ACV-3050, trade name, manufactured by Asahi Chemical Industry Co., Ltd.), to bring the salt concentration of the dispersion to 1/9, thereby obtaining a dispersion.

TABLE 22

| | Composition of dispersion |
|---|---|
| Polymer Latex a aqueous solution (solid content 13%) | 108.0 ml |
| Surfactant (5) | 20.0 g |
| Anionic surfactant (6) aqueous solution (5%) | 600.0 ml |
| Water | 1232.0 ml |

A gelatin dispersion of Stabilizer ①, whose formulation is shown in Table 23, was prepared. That is, the oil phase components were dissolved at room temperature to form a solution, and to the resultant solution, were added the aqueous phase components that had been heated to about 40° C., and after stirring and mixing them, the resultant mixture was dispersed for 10 min at 10,000 rpm by a homogenizer. To the resultant dispersion, was added additional water, followed by stirring, thereby obtaining a uniform dispersion.

TABLE 23

| | Composition of dispersion |
|---|---|
| Oil phase | |
| Stabilizer ① | 4.0 g |
| Sodium hydroxide | 0.3 g |
| Methanol | 62.8 g |
| High-boiling solvent ② | 0.9 g |
| Aqueous phase | |
| Gelatin from which calcium had been removed (Ca content 100 ppm or less) | 10 g |
| Antiseptic ① | 0.04 g |
| Water | 320.5 ml |

A gelatin dispersion of zinc hydroxide was prepared according to the formulation shown in Table 24. That is, after the components were mixed and dissolved, dispersing was carried out for 30 min in a mill, using glass beads having an average particle diameter of 0.75 mm. Then the glass beads were separated and removed off, to obtain a uniform dispersion. (Zinc hydroxide having an average grain size of 0.25 μm was used.)

TABLE 24

| | Composition of dispersion |
|---|---|
| Zinc hydroxide | 15.9 g |
| Carboxymethyl cellulose | 0.7 g |
| Poly(sodium acrylate) | 0.07 g |
| Lime-processed gelatin | 4.2 g |
| Water | 100 ml |
| High-boiling solvent ② | 0.4 g |

The preparation method of a gelatin dispersion of a matt agent that was to be added to the protective layer is described below.

A solution containing PMMA dissolved in methylene chloride was added, together with a small amount of a surfactant, to gelatin, and they were stirred and dispersed at high speed. Then the methylene chloride was removed off using a vacuum solvent removing apparatus, to obtain a uniform dispersion having an average particle size of 4.3 μm.

Cyan-dye-providing compound

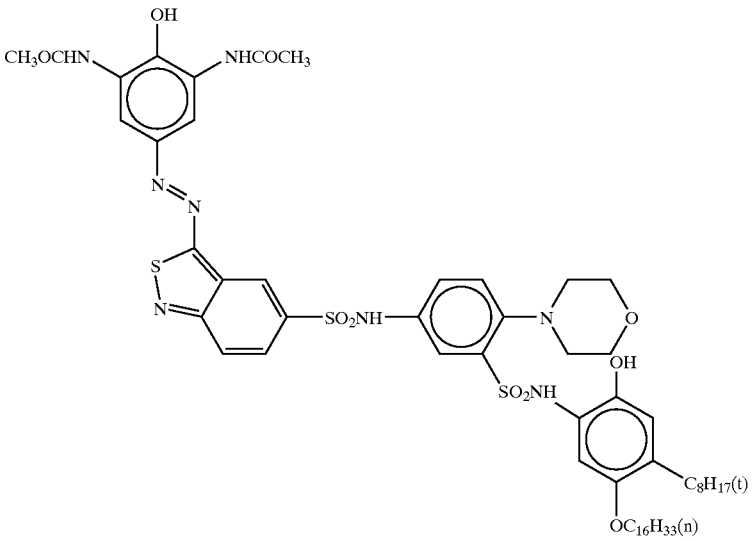

-continued
Dye (a)
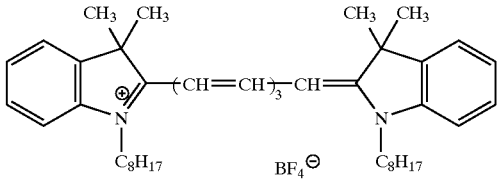
Magenta-dye-providing compound
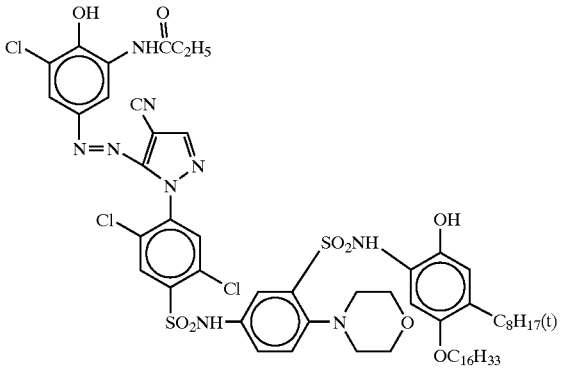
Yellow-dye-providing compound ①
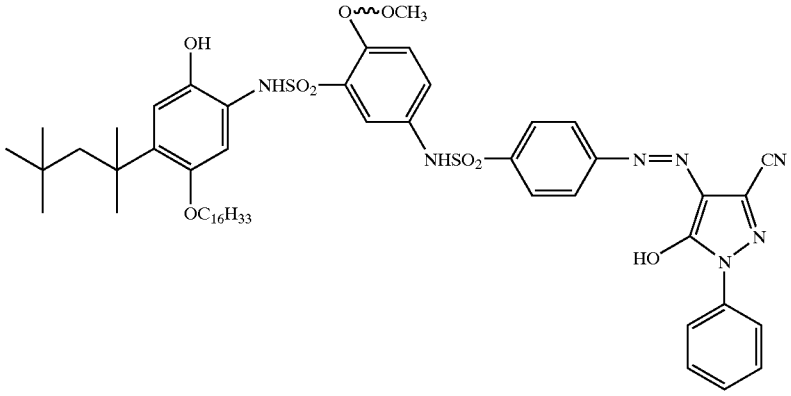
Yellow-dye-providing compound ②
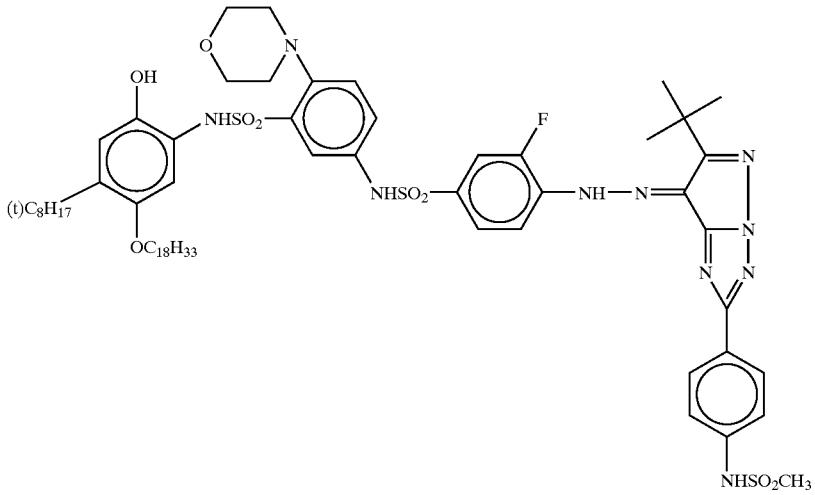
Reducing agent ①
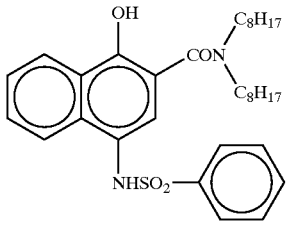
Antifoggant ③
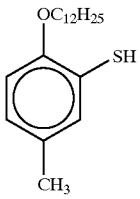

-continued
Antifoggant (4)
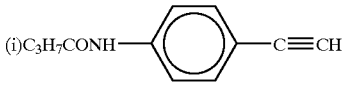
Developing accelerator (1)
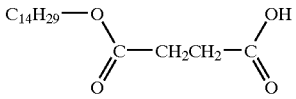
High-boiling solvent (2)
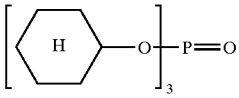
Antiseptic (3)
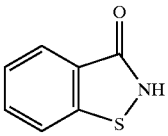
Antiseptic (4)
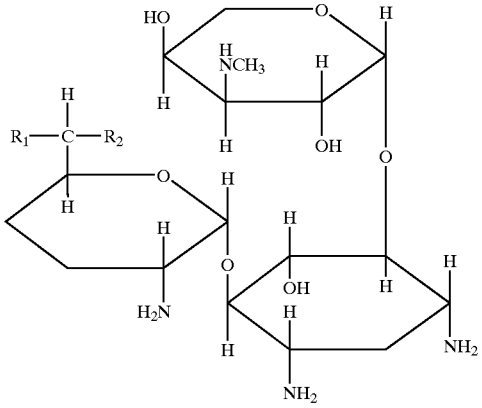
| | $R_1$ | $R_2$ |
|---|---|---|
| $C_1$ | $H_3C$— | —$NHCH_3$ |
| $C_2$ | $H_3C$— | —$NH_2$ |
| $C_{10}$ | H— | —$NH_2$ |
| $C_{20}$ | H— | —$NHCH_3$ |
Surfactant (3)
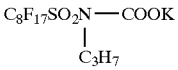
Surfactant (1)
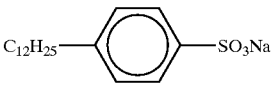
High-boiling solvent (1)
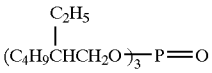
High-boiling solvent (3)
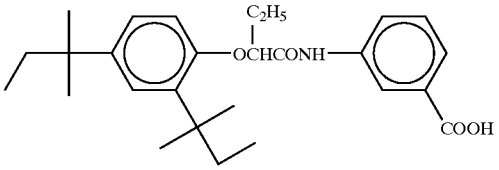
Reducing agent (2)
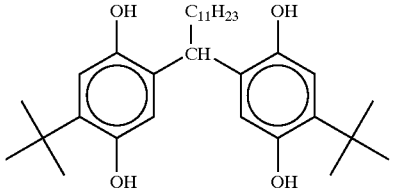
Surfactant (2)
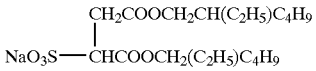
Water-soluble polymer (1)
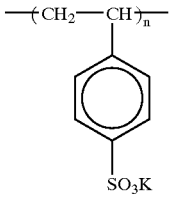
Limiting viscosity number [η] = 1.6
(0.1N NaCl, 30° C.)
Molecular mass = 1,000,000

-continued

Water-soluble polymer (2)

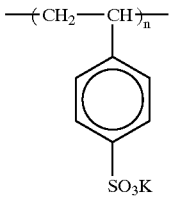

Limiting viscosity number [η] = 0.8
(0.1N NaCl, 30° C.)
Molecular mass = 400,000

Sensitizing dye (3)

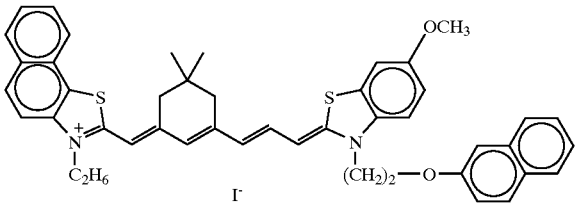

Surfactant (7)

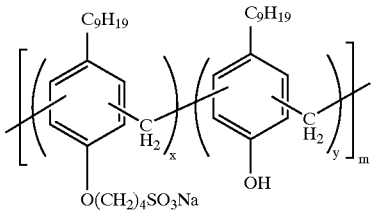

x:y = 4:6
m ≈ 6.8

Polymer latex a

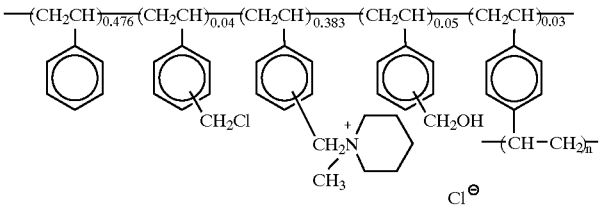

Surfactant (5)

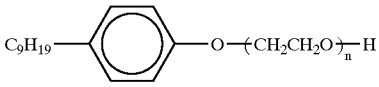

n = 60

Antifoggant (5)

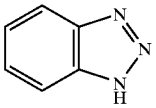

Hardener (1)

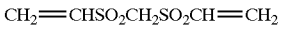

High-boiling organic solvent (5)

$C_{26}H_{46.9}Cl_{7.1}$

EMPARA 40 (trade name, manfactured by Ajinomoto K.K.)

Surfactant (4)

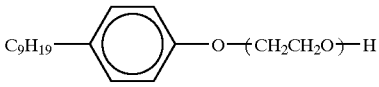

n = 50

Surfactant (6)

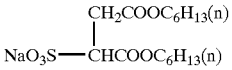

Using the above materials, a heat-developable color photosensitive material shown in Tables 25 was prepared.

TABLE 25

Constitution of Main Materials of Heat-Developable Photosensitive Material

| Number of layer | Name of layer | Additive | Coating amount (mg/m²) |
|---|---|---|---|
| Seventh layer | Protective layer | Acid-processed gelatin | 378 |
| | | Reducing agent (2) | 70 |
| | | High-boiling solvent (1) | 44 |
| | | Colloidal silver grain | 2 |
| | | Matt agent (PMMA resin) | 17 |
| | | Surfactant (1) | 19 |
| | | Surfactant (2) | 16 |

TABLE 25-continued

Constitution of Main Materials of Heat-Developable Photosensitive Material

| Number of layer | Name of layer | Additive | Coating amount (mg/m²) |
|---|---|---|---|
| | | Surfactant (3) | 2 |
| | | Surfactant (4) | 12 |
| | | Surfactant (6) | 17 |
| | | Polymer Latex a | 14 |
| | | Calcium nitrate | 5 |
| Sixth layer | Intermediate layer | Lime-processed gelatin | 882 |
| | | Zinc hydroxide | 577 |
| | | Antifoggant (4) | 18 |
| | | Reducing agent (1) | 2 |

TABLE 25-continued

Constitution of Main Materials of Heat-Developable Photosensitive Material

| Number of layer | Name of layer | Additive | Coating amount (mg/m$^2$) |
|---|---|---|---|
| | | High-boiling solvent (2) | 54 |
| | | High-boiling solvent (5) | 6 |
| | | Surfactant (1) | 11 |
| | | Surfactant (2) | 0.5 |
| | | Surfactant (7) | 11 |
| | | Water-soluble polymer (1) | 5 |
| | | Calcium nitrate | 17 |
| Fifth layer | 680 nm-light-sensitive layer | Lime-processed gelatin | 428 |
| | | Light-sensitive silver halide emulsion (1) | 287 |
| | | Magenta-dye-providing compound | 487 |
| | | High-boiling solvent (2) | 244 |
| | | Reducing agent (1) | 6 |
| | | Antifoggant (4) | 20 |
| | | Surfactant (1) | 22 |
| | | Water-soluble polymer (1) | 11 |
| Fourth layer | Intermediate layer | Lime-processed gelatin | 416 |
| | | Zinc hydroxide | 271 |
| | | Antifoggant (4) | 8 |
| | | Reducing agent (1) | 1 |
| | | High-boiling solvent (2) | 25 |
| | | High-boiling solvent (5) | 3 |
| | | Surfactant (1) | 5 |
| | | Surfactant (2) | 0.3 |
| | | Surfactant (7) | 5 |
| | | Water-soluble polymer (1) | 2 |
| | | Calcium nitrate | 8 |
| Third layer | 750 nm-light-sensitive layer | Lime-processed gelatin | 404 |
| | | Light-sensitive silver halide emulsion (2) | 184 |
| | | Stabilizer (1) | 8 |
| | | Cyan-dye-providing compound | 428 |
| | | Dye (a) | 13 |
| | | High-boiling solvent (1) | 128 |
| | | High-boiling solvent (2) | 429 |
| | | High-boiling solvent (3) | — |
| | | Reducing agent (1) | 28 |
| | | Antifoggant (3) | 5 |
| | | Surfactant (1) | 43 |
| | | Carboxymethyl cellulose | 7 |
| | | Water-soluble polymer (1) | 9 |
| Second layer | Intermediate layer | Lime-processed gelatin | 708 |
| | | Antifoggant (5) | 4 |
| | | Surfactant (2) | 2 |
| | | Surfactant (5) | 104 |
| | | Water-soluble polymer (2) | 14 |
| | | Calcium nitrate | 5 |
| First layer | 810 nm-light-sensitive layer | Lime-processed gelatin | 569 |
| | | Light-sensitive silver halide emulsion (3) | 330 |
| | | Fine-grain silver chloride emulsion | 30 |
| | | Stabilizer (1) | 8 |
| | | Yellow-dye-providing compound (1) | 119 |
| | | Yellow-dye-providing compound (2) | 285 |
| | | Sensitizing dye (3) | 0.1 |
| | | Dye (a) | 42 |
| | | High-boiling solvent (1) | 59 |
| | | High-boiling solvent (2) | 143 |
| | | Surfactant (1) | 41 |
| | | Reducing agent (1) | 33 |
| | | Development accelerator (1) | 71 |
| | | Antifoggant (3) | 6 |
| | | Water-soluble polymer (2) | 41 |
| | | Hardener (1) | 45 |

Support (Paper support whose both surfaces were laminated with polyethylene: thickness 135 $\mu$m)

(Note) Sensitizing dyes, antifoggants, and the like added together with the photosensitive silver halide, were not shown in the table. Conventional additives used in trace amounts, such as an antiseptic, were also omitted from description.

Image-forming Method

The dye-fixing elements 100 to 110 were each combined with the above-mentioned photosensitive material, and each combination was subjected to maximum exposure and development, using a printer sold under the trade name PICTROGRAPHY 3000 by Fuji Photo Film Co., Ltd., to yield a black solid image wherein Y, M and C components were color-developed up to maximum densities.

Light Fastness Evaluation Light-fading tests for the dye-fixing elements 100 to 110 were performed under the following conditions:

Fading tester: Weather-O-meter 65WRC (trade name), manufactured by ATLAS Co.;

Cycle: Light (100000 Lux)/Dark=3.8 hr/1 hr; and

Filter: none.

An X-rite 310TR (trade name) manufactured by X-rite Co. was used to measure the cyan reflection densities in the black solid image portion before the fading test and after the fading test of 2 weeks. Thus, dye-remaining rates after the color-fading test were calculated from the equation shown later. The values are shown in Table 26. In Table 26, the symbol "X" is attached to each of the dye-fixing elements that were substantially unsatisfactory for practical use, and the symbol "○" is attached to each of the dye-fixing elements that were satisfactory for practical use.

[Dye-remaining rate]=[reflection density after the fading test]/[reflection density before the fading test]

Film Strength Evaluation

The surface of each of the dye-fixing elements 100 to 110, which was obtained by the above-mentioned image-forming method, was subjected to a scratch test under the conditions shown below. The results are shown in Table 26. In Table 26, the symbol "X" is attached to each of the dye-fixing elements that substantially unsatisfactory for practical use, and the symbol "○" is attached to each of the dye-fixing elements that were satisfactory for practical use.

Scratch tester: continuous load type scratching tester TYPE 18, made by Shinto Scientific Co., Ltd.;

Scratching conditions: sapphire needle (diameter, 0.5 mm), a load of 0 to 100 g; and Environment: 25° C./50% RH

TABLE 26

Results of light fastness and scratch tests of images obtained by dye-fixing elements

| Dye-fixing element | | Dispersion medium | Ratio of dispersion medium/ ultraviolet absorber | Total weight of ultraviolet absorber and dispersion medium | Scratching test results * | Cyan dye remaining rate (%), Fastness evaluation ** |
|---|---|---|---|---|---|---|
| 100 | Comparative example | None | — | 0.0 g/m$^2$ | 70 g<br>○ | 47%<br>x |
| 101 | Comparative example | High-boiling organic solvent (1) | 40% | 0.7 g/m$^2$ | 15 g<br>x | 82%<br>○ |
| 102 | Comparative example | High-boiling organic solvent (1) | 100% | 1.0 g/m$^2$ | 5 g<br>x | 81%<br>○ |
| 103 | Comparative example | High-boiling organic solvent (1) | 140% | 1.2 g/m$^2$ | 0 g<br>x | 90%<br>○ |
| 104 | Comparative example | High-boiling organic solvent (2) | 40% | 0.7 g/m$^2$ | 20 g<br>x | 85%<br>○ |
| 105 | Comparative example | High-boiling organic solvent (2) | 100% | 1.0 g/m$^2$ | 10 g<br>x | 83%<br>○ |
| 106 | Comparative example | High-boiling organic solvent (3) | 40% | 0.7 g/m$^2$ | 10 g<br>x | 80%<br>○ |
| 107 | Comparative example | High-boiling organic solvent (3) | 100% | 1.0 g/m$^2$ | 0 g<br>x | 82%<br>○ |
| 108 | The present invention | Compound (1) | 40% | 0.7 g/m$^2$ | 70 g<br>○ | 85%<br>○ |
| 109 | The present invention | Compound (1) | 100% | 1.0 g/m$^2$ | 95 g<br>○ | 83%<br>○ |
| 110 | Comparative example | Compound (1) | 140% | 1.2 g/m$^2$ | 40 g<br>x | 89%<br>○ |

*: Regarding the scratch test results, a load at which the film was broken is shown in the upper portion, and evaluation is shown in the lower portion.
**: Regarding the fastness evaluation, a cyan dye-remaining rate of 80% or more, 50% or less, and a middle there-between are shown as ○, x, and Δ, respectively.

It can be understood from the above-mentioned results that the dye-fixing elements of the present invention produced a smaller undesired effect on diffusion transfer, and had a higher dye-remaining rate in the fading test, and superior film strength, than the comparative dye-fixing elements.

Having described our invention as related to the present embodiments, it is our intention that the invention not be limited by any of the details of the description, unless otherwise specified, but rather be construed broadly within its spirit and scope as set out in the accompanying claims.

What I claim is:

1. A dye-fixing element for color diffusion transfer process, having an ultraviolet-absorbing layer that contains an ultraviolet absorber in a coating amount of 0.2 g/m$^2$ or more, over a mordant layer; and containing, as at least one dispersion medium for the ultraviolet absorber, a compound represented by formula (1), in a ratio (mass ratio) of 25 to 200% of the ultraviolet absorber; with the sum of coating amounts of the ultraviolet absorber and total dispersion medium contained for the ultraviolet absorber being 1.0 g/m$^2$ or less;

Formula (1)

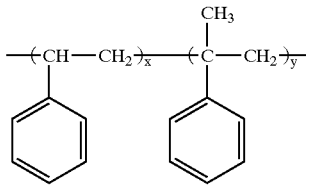

wherein x and y each represent a molar fraction of each recurring unit, the total of x and y is 1, and y ranges from 0.85 to 0.95.

2. The dye-fixing element according to claim 1, wherein the ultraviolet-absorbing layer contains a water-soluble polymer, as a binder, in an amount of 50 to 200% of the sum of masses of the ultraviolet absorber and total dispersion medium.

3. The dye-fixing element according to claim 2, wherein 50 to 100% of the water-soluble polymer used as a binder in the ultraviolet-absorbing layer is a gelatin.

4. The dye-fixing element according to claim 1, which is used in a heat-developable color diffusion transfer method.

5. The dye-fixing element according to claim 1, wherein the ultraviolet-absorbing layer is arranged between protective layers, or between a protective layer and a dye fixing layer.

6. The dye-fixing element according to claim 1, wherein a mass average molecular mass of the compound represented by the formula (1) is from 300 to 5,000.

7. An image-forming method, comprising subjecting a photosensitive material to imagewise exposure to light, and using a dye-fixing element and the exposed photosensitive material in combination, wherein the dye-fixing element has an ultraviolet-absorbing layer containing an ultraviolet absorber in a coating amount of 0.2 g/m$^2$ or more, over a mordant layer; and contains, as at least one dispersion medium for the ultraviolet absorber, a compound represented by formula (1), in a ratio (mass ratio) of 25 to 200% of the ultraviolet absorber; with the sum of coating amounts of the ultraviolet absorber and total dispersion medium contained for the ultraviolet absorber being 1.0 g/m$^2$ or less;

Formula (1)

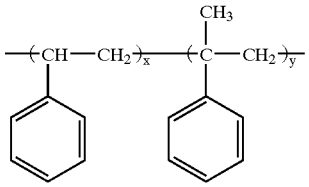

wherein x and y each represent a molar fraction of each recurring unit, the total of x and y is 1, and y ranges from 0.85 to 0.95.

8. The image-forming method according to claim 7, wherein the ultraviolet-absorbing layer contains a water-soluble polymer, as a binder, in an amount of 50 to 200% of the sum of masses of the ultraviolet absorber and total dispersion medium.

9. The image-forming method according to claim 8, wherein 50 to 100% of the water-soluble polymer used as a binder in the ultraviolet-absorbing layer is a gelatin.

10. The image-forming method according to claim 7, wherein the ultraviolet-absorbing layer is arranged between protective layers, or between a protective layer and a dye fixing layer.

11. The image-forming method according to claim 7, wherein a mass average molecular mass of the compound represented by the formula (1) is from 300 to 5,000.

* * * * *